US009347282B1

(12) United States Patent
Sipos

(10) Patent No.: US 9,347,282 B1
(45) Date of Patent: May 24, 2016

(54) HIGH TORQUE CAPACITY SPIDER

(71) Applicant: David L. Sipos, Lafayette, LA (US)

(72) Inventor: David L. Sipos, Lafayette, LA (US)

( * ) Notice: Subject to any disclaimer, the term of this patent is extended or adjusted under 35 U.S.C. 154(b) by 338 days.

(21) Appl. No.: 13/749,271

(22) Filed: Jan. 24, 2013

Related U.S. Application Data

(60) Provisional application No. 61/593,714, filed on Feb. 1, 2012.

(51) Int. Cl.
*E21B 19/10* (2006.01)

(52) U.S. Cl.
CPC ..... *E21B 19/10* (2013.01)

(58) Field of Classification Search
USPC ..... 166/78.1, 77.1; 175/195
See application file for complete search history.

(56) References Cited

U.S. PATENT DOCUMENTS

| | | | | |
|---|---|---|---|---|
| 2,939,683 | A | 6/1960 | Spiri | |
| 4,333,209 | A | 6/1982 | Herst | |
| 4,450,606 | A | 5/1984 | Broussard | |
| 4,531,875 | A | 7/1985 | Krueger | |
| 4,681,193 | A | 7/1987 | Crowe | |
| 7,117,938 | B2 | 10/2006 | Hamilton et al. | |
| 7,267,168 | B1 * | 9/2007 | Sipos | 166/77.52 |
| 7,665,551 | B2 | 2/2010 | Shahin et al. | |
| 7,681,649 | B2 | 3/2010 | Cerovsek | |
| 7,891,469 | B1 * | 2/2011 | Sipos | 188/67 |
| 2006/0290043 | A1 * | 12/2006 | Murata et al. | 269/290 |
| 2009/0056930 | A1 * | 3/2009 | Angelle et al. | 166/77.51 |
| 2009/0321086 | A1 | 12/2009 | Zimmermann | |

* cited by examiner

*Primary Examiner* — Taras P Bemko

(57) ABSTRACT

A low profile, high torque spider assembly for use on a rotary table of a drilling rig to secure a vertical pipe string such as a drill string is disclosed. The spider is comprised of a plurality of slips to engage with the drill string, a horizontal actuator, and a means for transferring the horizontal motion of the horizontal actuator to the vertical slips. Because of the horizontal orientation of the actuator means, this spider has a low deck profile and occupies less deck space, thereby making it particularly suitable for drilling rigs with small rotary table openings.

15 Claims, 9 Drawing Sheets

HIGH TORQUE CAPACITY SPIDER

PRIORITY

This application claims priority to U.S. provisional application entitled "High Torque Capacity Spider" bearing Ser. No. 61/593,714 filed Feb. 1, 2012, the entire content of which is hereby incorporated by reference.

FIELD OF INVENTION

This invention relates to pipe support devices known in the oil and gas drilling industry as spiders. More particularly, the invention relates to a high torque capacity spider that is particularly suitable for use in drilling rigs having a small rotary table opening.

BACKGROUND OF THE INVENTION

During the drilling of an oil and gas well, long strings of pipe are strung together to form a drill string or to form a casing string to line the well bore. These pipe strings are usually supported by rotary spiders that fit into or over the opening of a rotary table on the drilling rig. Spiders typically employ slips that are peripherally distributed around an inwardly tapered cylindrical bowl. The slips are typically fitted with detachable gripping dies. Such gripping dies having a plurality of teeth the form a pipe gripping surface to increase the grip of the slips on the pipe string.

Spider slips are typically attached to a slip timing ring by a linkage so that upward and downward movement of the slip timing ring will simultaneously move the slips upward and downward in the slip bowl for engaging and releasing the pipe string. Vertically extending hydraulically or pneumatically powered cylinders having extendable and retractable pistons and rods are typically used to raise and lower the slip timing ring.

When a pipe string suspended in the well is to be gripped by the spider, the piston rods of the hydraulic cylinders are retracted to move the timing ring and thus the slips downward so that the inwardly tapered slip bowl surface will urge the downwardly moving slips radially inward to bear upon and grip the pipe. When the pipe string is to be released, the piston rods of the hydraulic cylinders are extended to move the timing ring and thus the slips upward in the tapered slip bowl so that the upwardly moving slips move radially outward away from the pipe string in order to release the pipe.

Ideally, the spider is designed to have the lowest possible elevation profile with respect to the top of the rotary table. Lowering the elevation profile of the spider above the top of the rotary table will provide workers with more work room and offer less interference in the work space area around the spider. Flush mounted spiders having the slip bowl and slip assemblies and the hydraulic cylinders used to power the slips upward and downward all within the confines of the rotary table opening. Such flush mounted spiders often have a lower elevation profile above the top of the rotary table.

In drilling rigs with small rotary table openings particularly 17½ inch or less, there is often insufficient room within the rotary table opening for a flush mounted spider that utilizes a power slip mechanism such as hydraulic cylinders to raise and lower the slips. In situations where such a spider will fit in the rotary table opening, its pipe size and pipe weight capacity is often severely limited. Such limitations on the pipe size and pipe weight capacity may present safety concerns as well as limitations on the depth and type of well in which the spider is to be utilized. In such situations powered spiders that rest upon the top of the rotary table are utilized. However, the slip bowl and the hydraulic cylinders of these top mounted spiders will often extend the elevation profile of the spiders several feet above the top of the rotary table.

Consequently, there is a need for a rotary table spider that will have or approach the low elevation profile of many flush mounted spider designs. Further, there is a need for a powered rotary table spider that may be utilized on rotary table having a small opening but that will still offer a high torque and weight capacity.

SUMMARY OF THE INVENTION

A low profile high torque capacity powered rotary table spider is described. The spider is intended for use in conjunction with the rotary table of a drilling rig, the rotary table having an opening for insertion of a length of pipe. The spider described herein has a frame that rest upon the top of the rotary table and over the rotary table opening. Mounted to the frame and positioned to extend downwardly into the opening of the rotary table is a plurality of inwardly tapered slip carrier plates. A slip carrying a pipe gripping die is configured to move upward and downward along each inwardly tapered slip carrier plate by means of a timing ring that moves in response to a "rack and pinion" slip driving mechanism.

The rack and pinion slip driving mechanism is comprised of linear actuators such as horizontally oriented hydraulic cylinders having extendable and retractable rods. The rods of the horizontally oriented hydraulic cylinders are attached to horizontally oriented linear gear racks. These horizontal gear racks are configured to move horizontally backward and forward in response to the extension and retraction of the hydraulic cylinder rods. Each horizontal gear rack has a plurality of gear teeth configured to engage the gear teeth of a corresponding circular pinion gear so that the backward and forward movement of the gear rack will rotate the corresponding pinion in alternating clockwise and counterclockwise rotation as desired.

Each pinion is also configured to engage with the teeth of a vertically extending gear rack that is slidably mounted to extend vertically through a corresponding opening in the spider frame. In this configuration, the alternating clockwise and counter clockwise rotation of the pinion will vertically retract and extend the corresponding vertical gear rack through the opening in the spider frame, into and out of the rotary table opening.

The vertical gear racks are mounted to a slip timing ring. Attached to the timing ring by a suitable linkage is a plurality of slips, with each slip carrying at least one gripping die. Each die carrying slip is configured to slidably engage one of the downwardly extending tapered slip carrier plates. In this configuration, upward and downward movement of the vertical gear racks will move the slips upward and downward along the slip carrier plates.

To operate the powered rotary table spider to release a pipe or pipe string, the rods of the horizontally oriented hydraulic cylinders are extended to move the horizontal gear rack outwardly and thereby rotate the pinions in a counterclockwise direction. The counterclockwise rotation of the pinions will then extend the vertical gear rack out of the rotary table opening, raise the attached timing ring, and move the associated slips upward and radially outward to release the pipe or pipe string.

Gripping the pipe string is the reverse or the release procedure. The rods of the horizontally oriented hydraulic cylinders are retracted to move the horizontal gear rack inwardly and thereby rotate the pinions in a clockwise direction. The clockwise rotation of the pinions will then retract the vertical gear rack into the rotary table opening, lower the attached timing ring, and move the associated slips downward along the tapered slip carrier plates and radially inward to grip a pipe or pipe string.

DESCRIPTION OF THE EMBODIMENT

Figure 1:
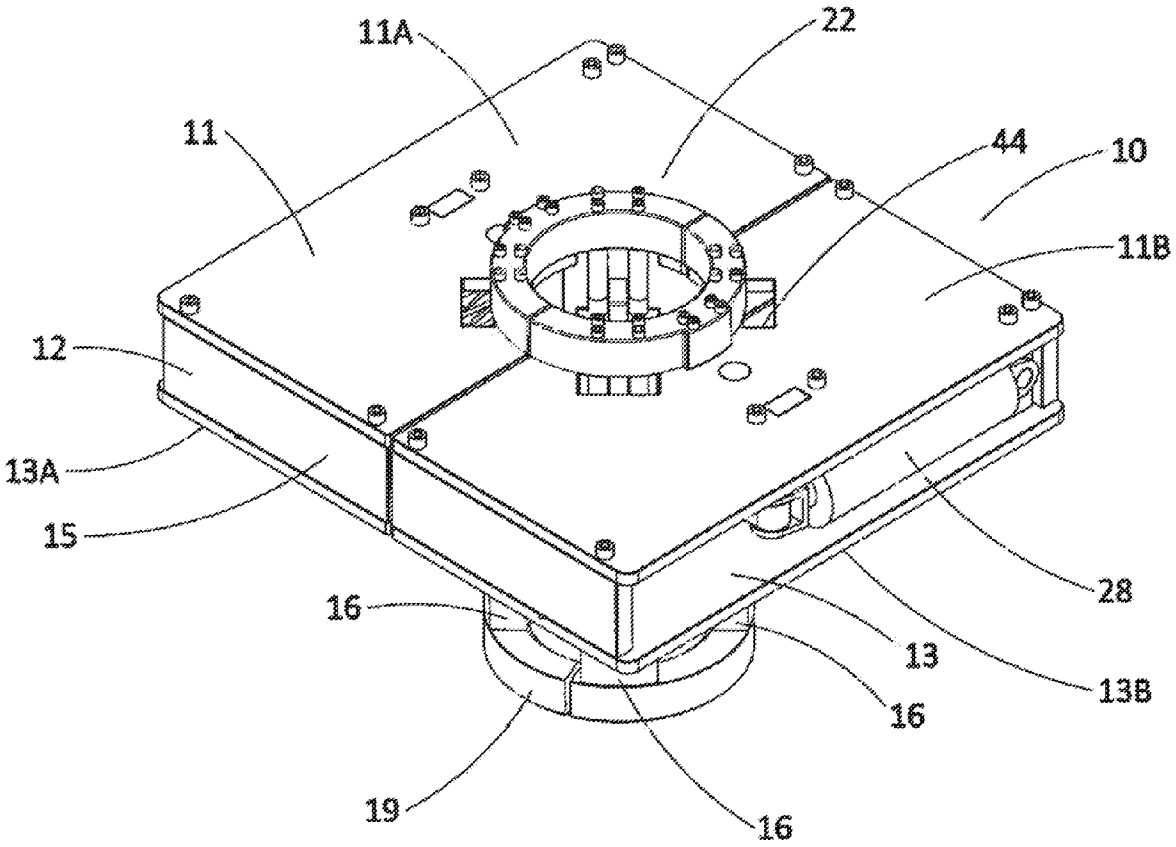
FIG. 1 is an isometric top view of the rotary table spider described herein with the timing ring and slips in a lowered or down position.
Figure 2:
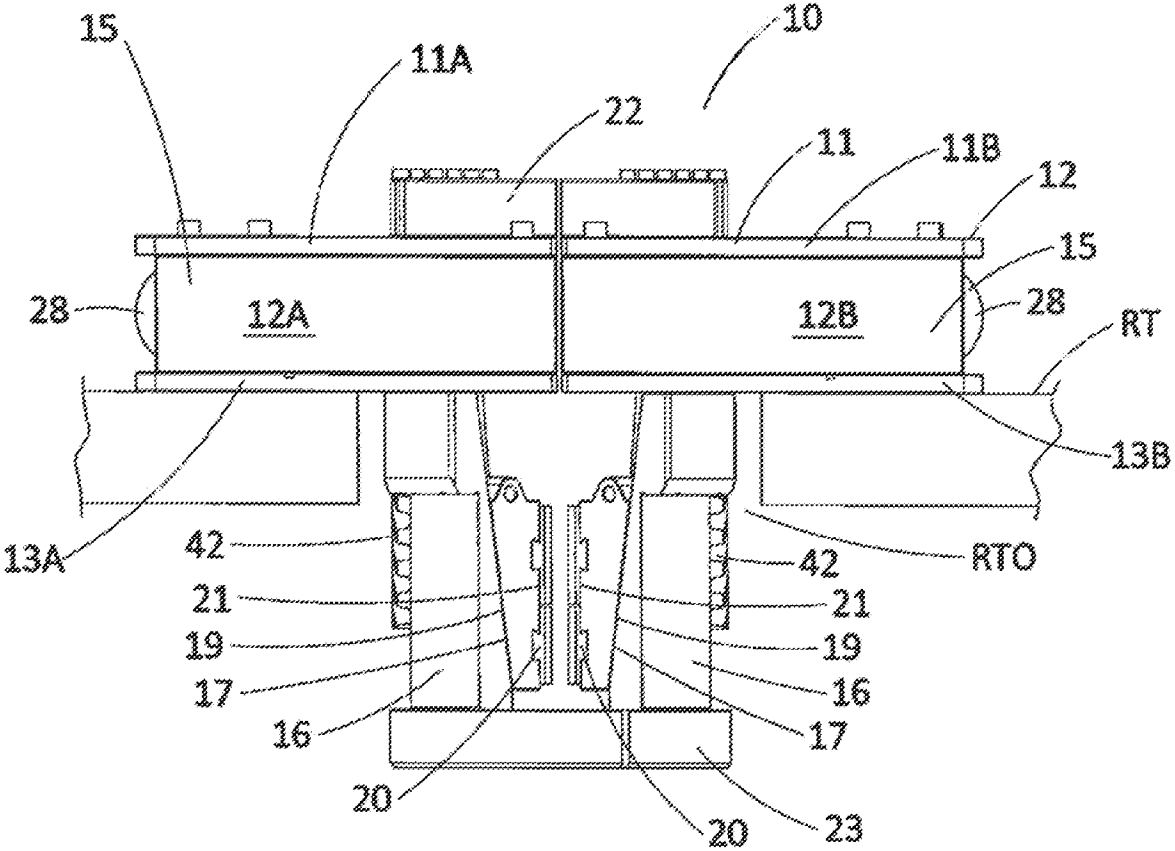
FIG. 2 is an elevation view of the rotary table spider shown in FIG. 1 with the timing ring and slips in a lowered or down position.
Figure 3:
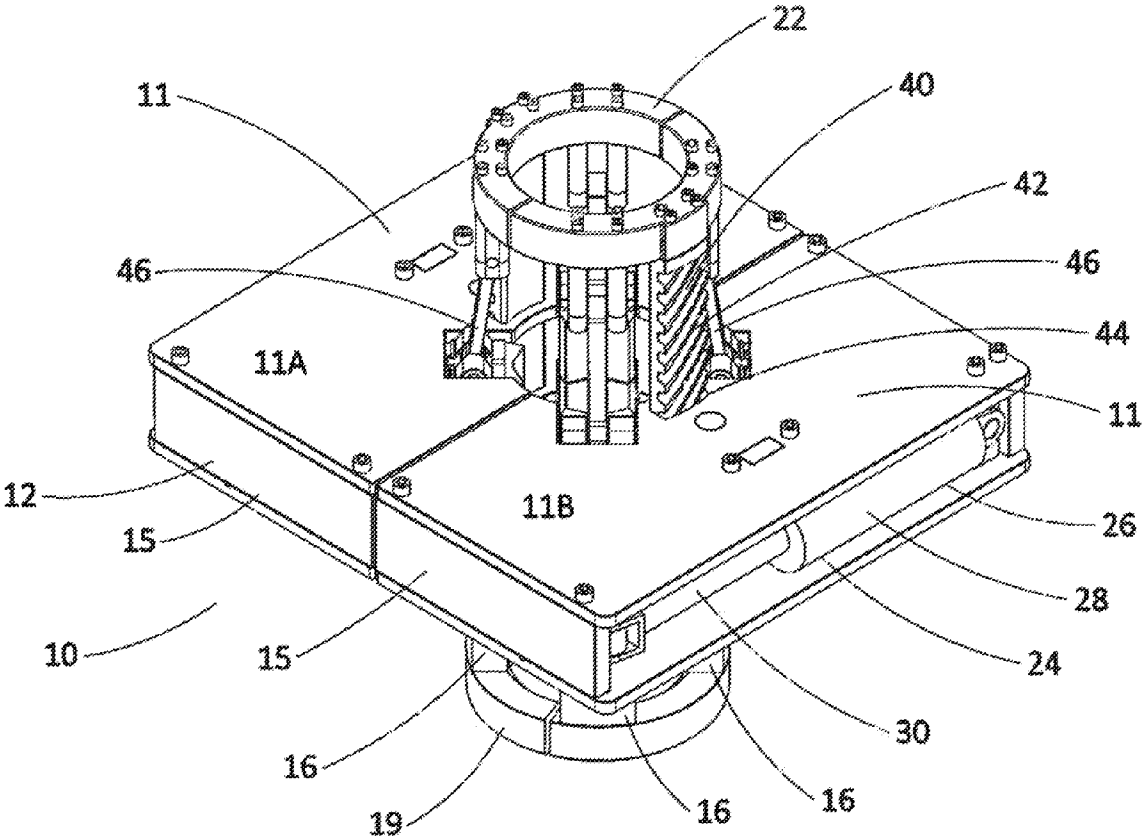
FIG. 3 is a perspective view of the rotary table spider shown in FIG. 1 with the timing ring and slips in a raised or up position.
Figure 4:
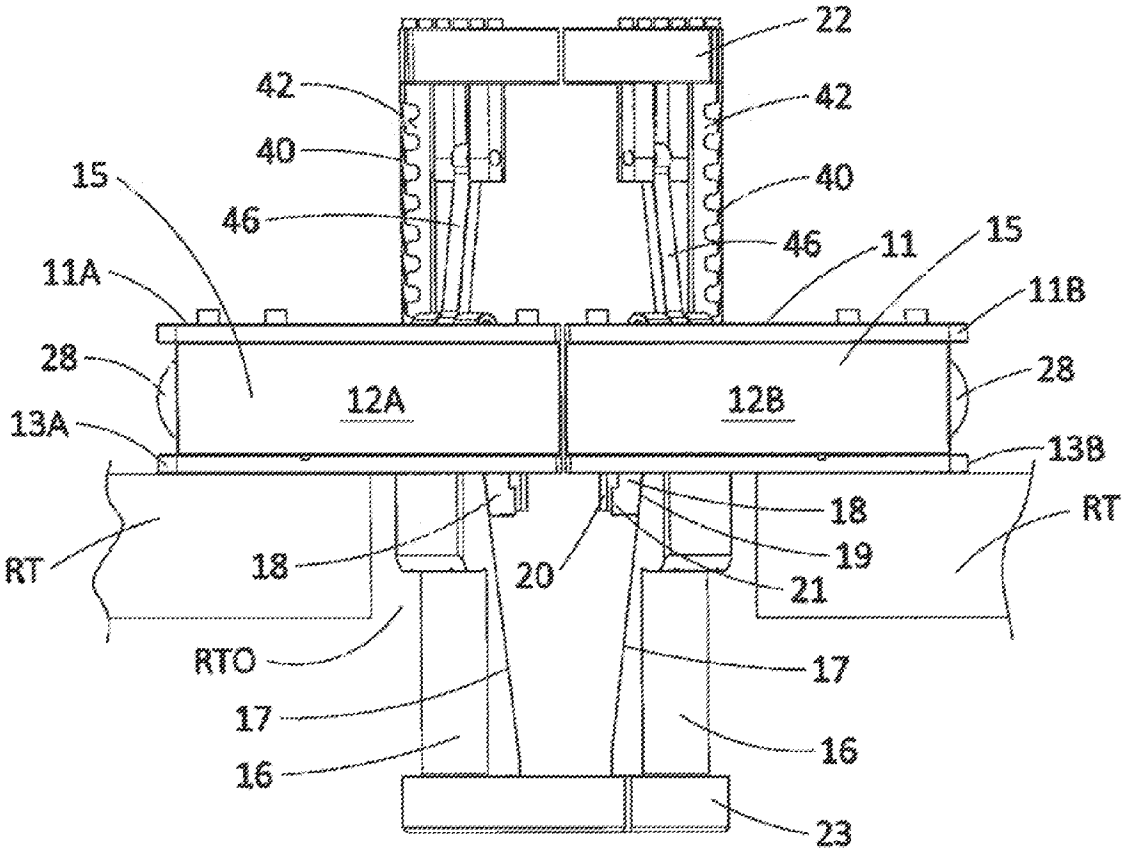
FIG. 4 is an elevation view of the rotary table spider shown in FIG. 1 with the timing ring and slips in a raised or up position.
Figure 5:
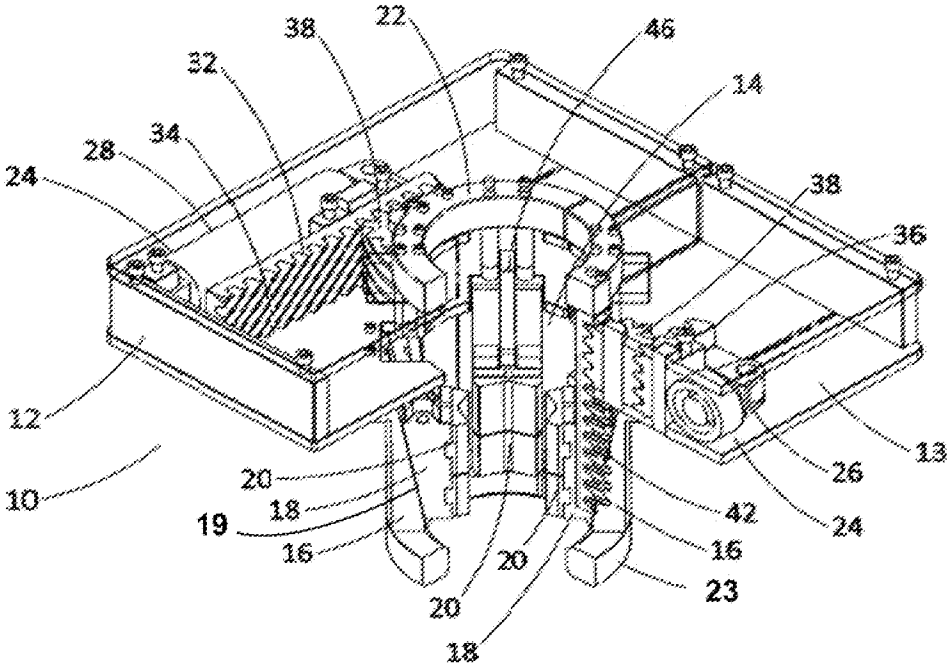
FIG. 5 is a partial cutaway perspective view of the rotary table spider shown in FIG. 1 with the timing ring and slips in a lowered or down position.
Figure 6:
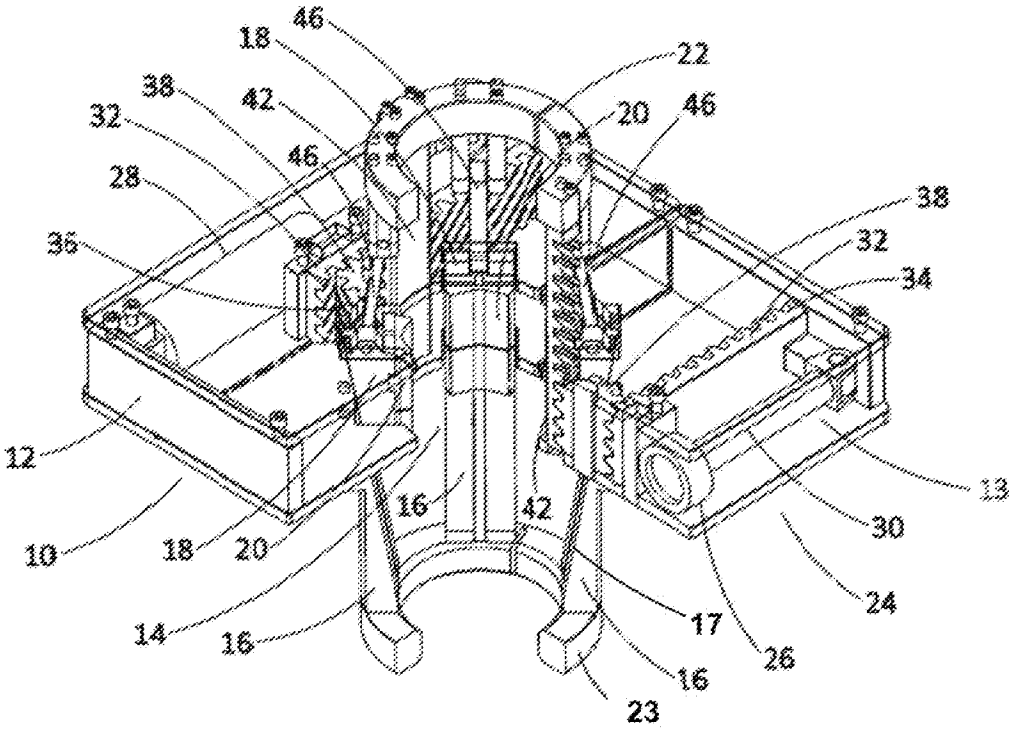
FIG. 6 is a partial cutaway perspective view of the rotary table spider shown in FIG. 1 with the timing ring and slips in a raised or up position.

FIG. 1 shows an isometric top view of the low profile high torque capacity powered rotary table spider (10) of Applicant's invention. FIG. 2 is an elevation view of the rotary table spider shown in FIG. 1. The spider (10) is intended for use in conjunction with a rotary table of a drilling rig, the rotary table having an opening for insertion of a length of pipe. As shown in FIG. 2, the spider (10) rests upon the top of the rotary table (RT) of a drilling rig.

The spider (10) has a frame (12) comprised of a plurality of floor beam sections (15). Positioned on the frame (12) is a frame top (11) and a frame bottom (13) comprised of steel plates. The frame top (11) and frame bottom (13) are configured to create an opening (14) that corresponds with the opening (RTO) in the rotary table. As shown in FIGS. 1 and 2, the frame top (11) and frame bottom (13) may be split into two or more sections shown as top plate sections (11A, 11B) and bottom plate sections (13A, 13B). Similarly, the frame (12) may be split and assembled in two sections (12A, 12B). Having a frame (12) that may be assembled and disassembled in sections will facilitate assembly and disassembly of the spider and will simply maintenance or repair of the spider on the rig floor if necessary.

Referring now to FIGS. 3-6, the spider (10) is provided with a plurality of radially oriented slip carrier plates (16) that are distributed peripherally around and secured to a slip carrier plate support ring (23) and mounted to the frame (12). The slip carrier plates (16) are positioned to extend downwardly from the frame opening (14) into the rotary table opening (RTO). Each slip carrier plate (16) has an inwardly tapered interior surface (17) and is provided with a corresponding slip (18) having a tapered exterior surface (19) and a substantially vertical interior surface (21). Each slip (18) is configured to carrying at least one pipe gripping die (20) on its interior surface (21). Preferably the gripping die (20) is a detachable and replaceable die that has a V-shaped gripping surface to engage the outer surfaces of the pipe along single vertical lines. However, the gripping die may have any suitable configuration. Mating T-slots, dovetail joints, or any other suitable engagement means or any machine slide where the die can detachably connect to a slip may be utilized.

The tapered exterior surface (19) of each slip (18) is configured to slidably engage with the inwardly tapered interior surface (17) of its corresponding slip carrier plate (16) so that the slip (18) may be moved vertically upward and downward along the inwardly tapered interior surface of its corresponding slip carrier plate (16). Such upward and downward slip movement will result in a corresponding radial inward and outward movement of each slip (18) and die (20) with respect to the rotary table opening. Mating T-slots, dovetail joints, rollers, or any other suitable type of machine slides may be utilized for slidable engagement of the slip carrier plate (16) and the slip (18).

Upward and downward and inward and outward slip movement is accomplished by a timing ring (22) pivotally attached to each slip (18) by a suitable linkage (46). The timing ring (22) is attached to a pair of "rack and pinion" driving assemblies each shown generally as (24) that move the timing ring (22), and each attached slip (18), upward and downward, and thereby radially inward and outward, in response to reciprocal motion of the driving assembly (24). The timing ring (22) may be split and assembled in two or more parts to facilitate removal of the slip and die components if necessary.

The rack and pinion driving assembly (24) is comprised of a pair of horizontally positioned linear actuators (26) mounted within the frame (12). Preferably, the linear actuators (26) are horizontally oriented hydraulic cylinders (28) having extendable and retractable rods (30). However, other types of linear actuators may be utilized for the linear actuators (26). For example each linear actuator (26) may be a mechanical linear actuator such as a screw jack.

Mounted to the rods (30) of the hydraulic cylinders (28) of the linear actuators (26) are horizontally oriented linear gear racks (32). The horizontal gear racks (32) form the first rack of the rack and pinion assembly (24). The horizontal gear racks (32) are configured to move horizontally backward and forward in response to the extension and retraction of the hydraulic cylinder rods (30). Each of the gear racks (32) has a plurality of gear teeth (34) configured to engage with the gear teeth (36) of a corresponding circular gear or pinion (38) so that the backward and forward movement of the gear rack (32) will rotate the corresponding pinion (38) in alternating clockwise and counterclockwise rotation as desired.

Each pinion (38) is also configured to engage with the teeth (40) of a second gear rack (42) that is slidably mounted to extend vertically through a corresponding opening (44) in the spider frame (12). In this configuration, the rotation of the pinion (38) in alternating clockwise and counter clockwise rotation will vertically retract and extend the corresponding vertical gear rack (42) through the opening (44), into and out of the rotary table opening (RTO).

Figure 8:
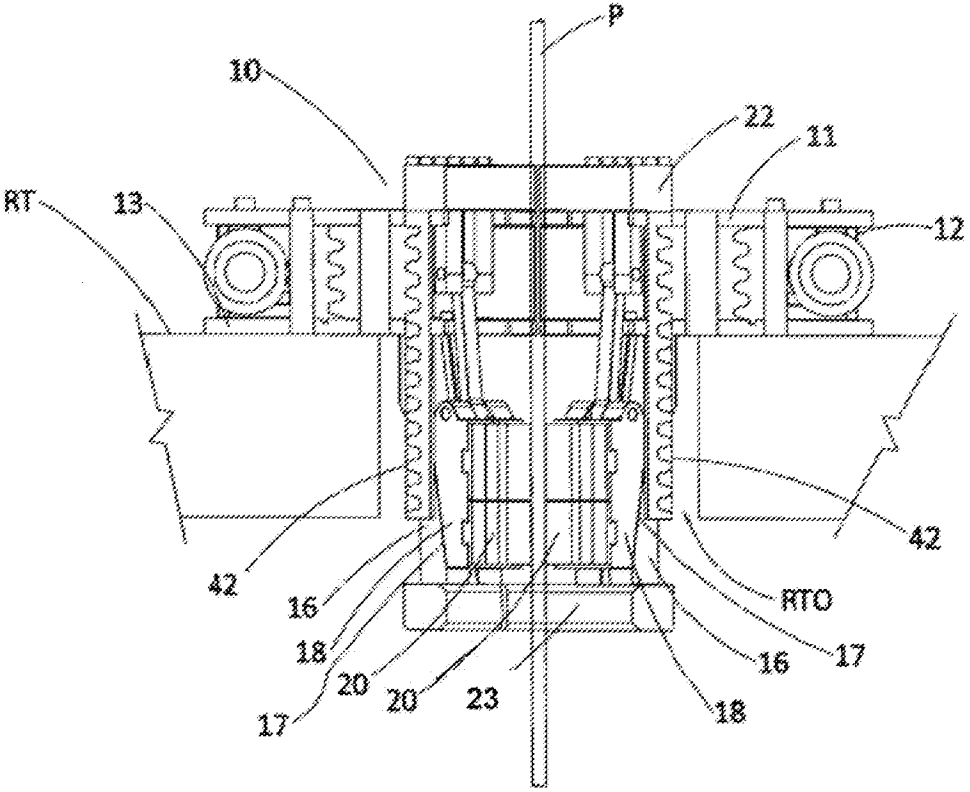
FIG. 8 is a partial cross-section elevation view of the rotary table spider shown in FIG. 1 with the timing ring and slips in a lowered or down position gripping a pipe or pipe string.

In operation, a pipe or pipe string is gripped by the dies (20) of the spider (10) by retracting the rods (30) of the horizontally oriented hydraulic cylinders (30) to move the horizontal gear racks (32) inwardly and thereby rotate the pinions (38) in a clockwise direction. The clockwise rotation of the pinions (38) will then retract the vertical gear racks (42) downward into the rotary table opening (RTO), lower the attached timing ring (22), and move the associated slips (18) downward along the slip carrier plates (16) and radially inward to engage the dies (20) with the pipe or pipe string (P) as shown in FIG. 8.

Figure 9:
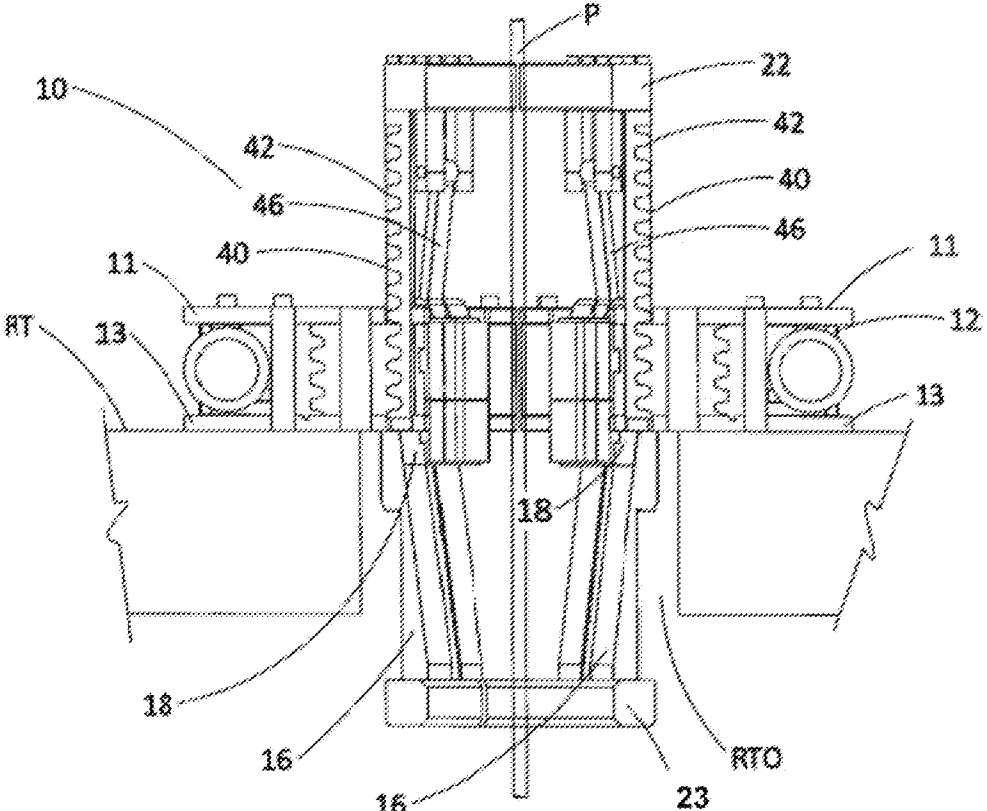
FIG. 9 is a partial cross-section elevation view of the rotary table spider shown in FIG. 1 with the timing ring and slips in a raised or up position releasing a pipe or pipe string.

The release of a pipe string is the reverse of the gripping procedure. A pipe or pipe string is released from the spider (10) by extending the rods (30) of the horizontally oriented hydraulic cylinders (28) to move each horizontal gear racks (32) outwardly and thereby rotate each pinion (38) in a counterclockwise direction. The counterclockwise rotation of the pinions (38) will then raise each vertical gear rack (42) upward out of the rotary table opening (RTO), raise the attached timing ring (22), and move the associated slips (18) upward and radially outward along the slip carrier plates (16) to release the pipe or pipe string from the gripping dies (20) as shown in FIG. 9.

Due to the force exerted on the gripping dies (20) of the slips (18) by means of the rack and pinion drive mechanism (24), the spider (10) can be used to provide a high resistance against rotational torque that might be exerted on the pipe string. This will be especially beneficial during the making up and breaking out of the pipe segments used to create the pipe string.

Figure 7:
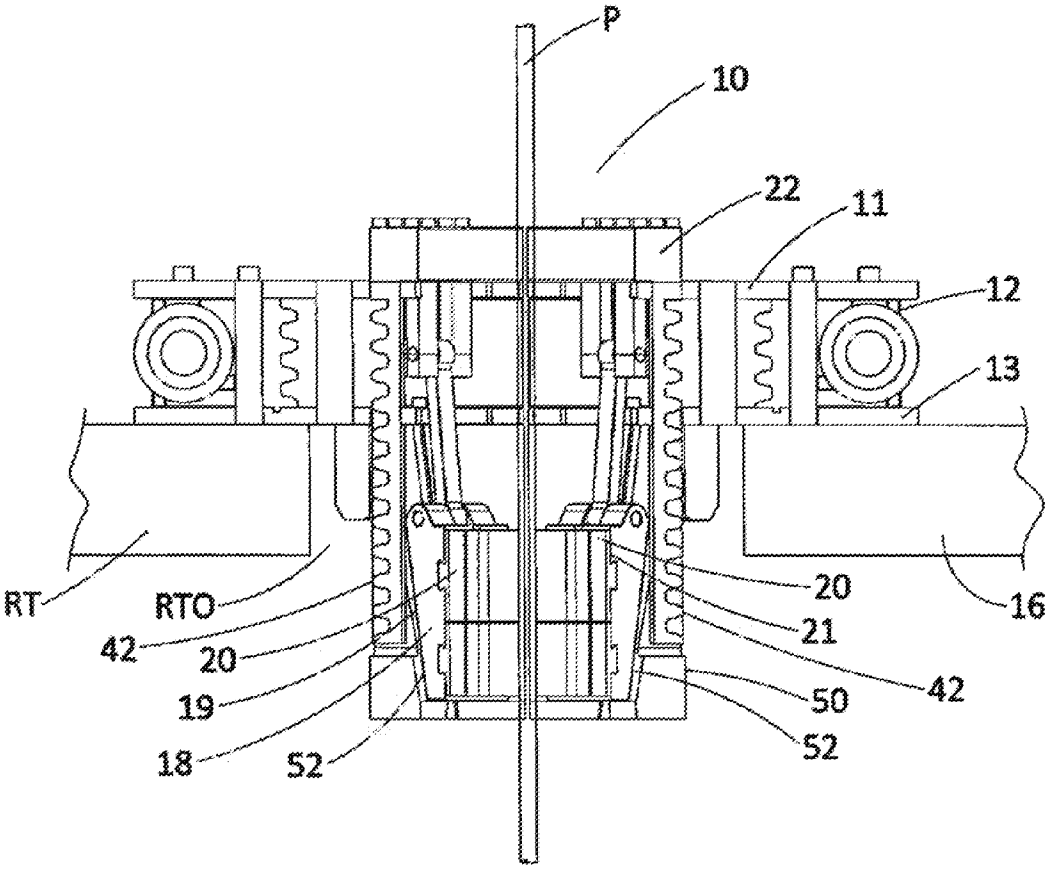
FIG. 7 is a cross-section view of an alternate embodiment of the rotary table spider described herein with the timing ring and slips in a lowered or down position.

An alternate embodiment of the spider (10) is shown in FIG. 7. In this embodiment a funnel shaped, vertically extending, open ended, bushing or bowl (50) having an inwardly tapered interior surface (52) with atop and a bottom opening is substituted for the individual the slip carrier plates (16). The each slip (18) of the plurality of tapered slips (18) is slidably engaged with the interior surface (52) of the bowl (50). As the slips (18) are moved upward and downward in response to movement of the timing ring (22), the slips will move radially outward and inward along the interior surface (52) to release and grip the pipe or pipe string. The bowl (50) is configured to be placed into the rotary table opening (RTO).

The slips (18) and the interior bowl surface (52) may be machined or otherwise configured with slip interface surfaces, such as dovetails, T-slots, or similar machine slides to facilitate the salable engagement and movement of the slips (18). The slip interface surfaces could be machined on the interior of the bowl to engage with the slips (18). The bowl (50) may also be split into two or more sections to facilitate repair or removable of the spider (10) from the rotary table opening.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A rotary table spider for use on a drilling rig comprising:

(a) a plurality of slip carriers attached to a frame assembly, said slip carriers having an inwardly tapered interior surface, said slip carriers arrayed radially around the periphery of an opening in said frame;

(b) a vertically oriented slip slidably engaged with said interior surface of each said slip carrier;

(c) a horizontally oriented linear actuator mounted with said frame assembly whereby horizontal forces may be generated;

(d) a rack and pinion driving assembly translating horizontal forces from said horizontally oriented linear actuator to move each said slip upward and downward and thereby moving said slip radially outward and inward; and (e) wherein said rack and pinion driving assembly comprises:

a) a horizontally oriented gear rack affixed to said horizontally oriented linear actuator;

b) a pinion gear rotatably engaged with said horizontally oriented gear rack;

c) a vertically oriented gear rack rotatably engaged with said pinion gear;

d) a slip timing ring affixed to said vertical linear gear rack; and e) a linkage connecting said slip timing ring to said plurality of slips.

2. A rotary table spider for use on a drilling rig comprising:

a) a frame having an opening;

b) a slip carrier mounted to said frame and positioned around said frame opening;

c) at least one slip slidably attached to said slip carrier;

d) a timing ring pivotally attached to said slip;

e) at least one horizontally oriented hydraulic cylinder attached to said frame, said hydraulic cylinder having an extendable and retractable cylinder rod;

f) a horizontally oriented rack gear attached to said cylinder rod;

g) a pinion rotatably engaged with said horizontal gear rack; and h) a vertically oriented gear rotatably engaged with said pinion, said vertically oriented gear attached to said timing ring.

3. The spider of claim 2, wherein said frame has at least two sections connected together.

4. The spider of claim 3, wherein said slips are configured to move on said slip carrier by means of a slip carrying interface between said slip and said slip carrier.

5. The spider of claim 4 wherein said slip is attached to a corresponding pipe gripping die.

6. The spider of claim 5, wherein said die is configured to form a V-shaped gripping surface shaped to engage with an outer radial surface of a pipe along single vertical lines.

7. The spider of claim 5 wherein said slip carrier is comprised of a plurality of vertically extending plates arranged radially around said frame opening.

8. The spider of claim 5 wherein said slip carrier is a vertically extending inwardly tapered bowl having top and bottom openings, said bowl positioned within said frame opening.

9. A rotary table spider comprising:

a) a horizontally extending frame having an opening;

b) a plurality of vertically oriented slip carrier plates mounted to said frame in a position radially around said frame opening, said slip carrier plates having an inwardly tapered interior radial surface;

c) at least one slip slidably attached to each said slip carrier plate, said slip having at least one pipe gripping die;

d) a timing ring pivotally attached to each said slip;

e) at least one linear actuator mounted with said frame whereby a horizontal force and motion may be generated; and f) a horizontally oriented rack gear attached to said linear actuator whereby said horizontally oriented rack gear will move horizontally in response to said force and motion of said linear actuator;

g) a pinion rotatably engaged with said horizontal gear rack whereby said pinion will rotate in response to horizontal motion of said horizontally oriented rack gear; and h) a vertically oriented gear rack rotatably engaged with said pinion, said vertically oriented gear rack attached to said timing ring whereby rotation of said pinion will move said vertically oriented gear rack and said attached timing ring upward and downward thereby moving and said slips upward and downward and radially outward and inward along said inwardly tapered interior radial surface of said slip carrier plates.

10. The spider of claim 9 wherein each said slip carrier and said slip are slidably engaged by means of a machine slide.

11. The spider of claim 10 wherein said linear actuator is a hydraulic cylinder.

12. A rotary table spider comprising:

(a) a frame assembly;

(b) a vertically extending slip carrier attached to said frame assembly;

(c) a slip attached to said slip carrier, wherein said slip is slidingly engaged with said slip carrier;

(d) a horizontal linear actuator attached to said frame, said horizontal linear actuator comprising a horizontally oriented hydraulic cylinder having an extendable and retractable piston and rod;

(e) a rack and pinion driving assembly translating horizontal motion from said horizontal linear actuator to said slip thereby moving said slip vertically on said slip carrier; and (f) wherein said rack and pinion driving assembly includes:

(i) a horizontally oriented rack gear attached to said linear actuator whereby said horizontally oriented rack gear will move horizontally in response to said force and motion of said linear actuator;

(ii) a pinion rotatably engaged with said horizontal gear rack whereby said pinion will rotate in response to horizontal motion of said horizontally oriented rack gear; and (iii) a vertically oriented rack gear rotatably engaged with said pinion.

13. The spider of claim 12, wherein said slip carrier is an inwardly tapered plate.

14. The spider of claim 12, wherein said slip carrier is comprised of an inwardly tapered bowl.

15. The spider of claim 12, wherein said slip is attached to a pipe gripping die.

* * * * *